US009114506B1

(12) United States Patent
Olson

(10) Patent No.: US 9,114,506 B1
(45) Date of Patent: Aug. 25, 2015

(54) APPARATUS AND METHOD FOR CLAMPING MITERED CORNERS

(76) Inventor: Kevin Olson, Norman, OK (US)

( * ) Notice: Subject to any disclaimer, the term of this patent is extended or adjusted under 35 U.S.C. 154(b) by 967 days.

(21) Appl. No.: 13/286,512

(22) Filed: Nov. 1, 2011

Related U.S. Application Data

(60) Provisional application No. 61/409,031, filed on Nov. 1, 2010.

(51) Int. Cl.
*B25B 5/00* (2006.01)

(52) U.S. Cl.
CPC ..... *B25B 5/00* (2013.01)

(58) Field of Classification Search
CPC ..... B25B 5/00; B21D 43/003; B21D 43/10; B23K 37/0533
USPC ..... 269/131, 111, 45, 75, 71
See application file for complete search history.

(56) References Cited

U.S. PATENT DOCUMENTS

| | | | | |
|---|---|---|---|---|
| 4,163,547 | A * | 8/1979 | Jerome | 269/42 |
| 5,440,818 | A * | 8/1995 | Mailhot | 33/452 |
| 6,039,313 | A * | 3/2000 | Baculy | 269/168 |
| 7,814,672 | B1 * | 10/2010 | Johnson, Jr. | 33/414 |
| 2001/0034945 | A1 * | 11/2001 | Smochek | 33/373 |
| 2004/0216316 | A1 * | 11/2004 | Ellis et al. | 33/471 |
| 2012/0285028 | A1 * | 11/2012 | Atwood | 33/452 |

* cited by examiner

*Primary Examiner* — Lee D Wilson

(57) ABSTRACT

A kit for clamping and joining a miter joint between a first frame member and a second frame member comprising a band retaining member and a clamp band. The band retaining member has a base portion that is adapted to be positioned and attached adjacent the first and second frame members when the first and second frame members are together to form the mitered corner. The band retaining member has at least one band retainer extending from the base portion. The clamp band is wrapped around the first and second mitered frame members and about the at least one band retainer of the band retaining member in such a way that the clamp band is held in position while it extends across the mitered corner so as to exert a compressive force in a direction substantially perpendicular to the joint of the mitered corner.

8 Claims, 10 Drawing Sheets

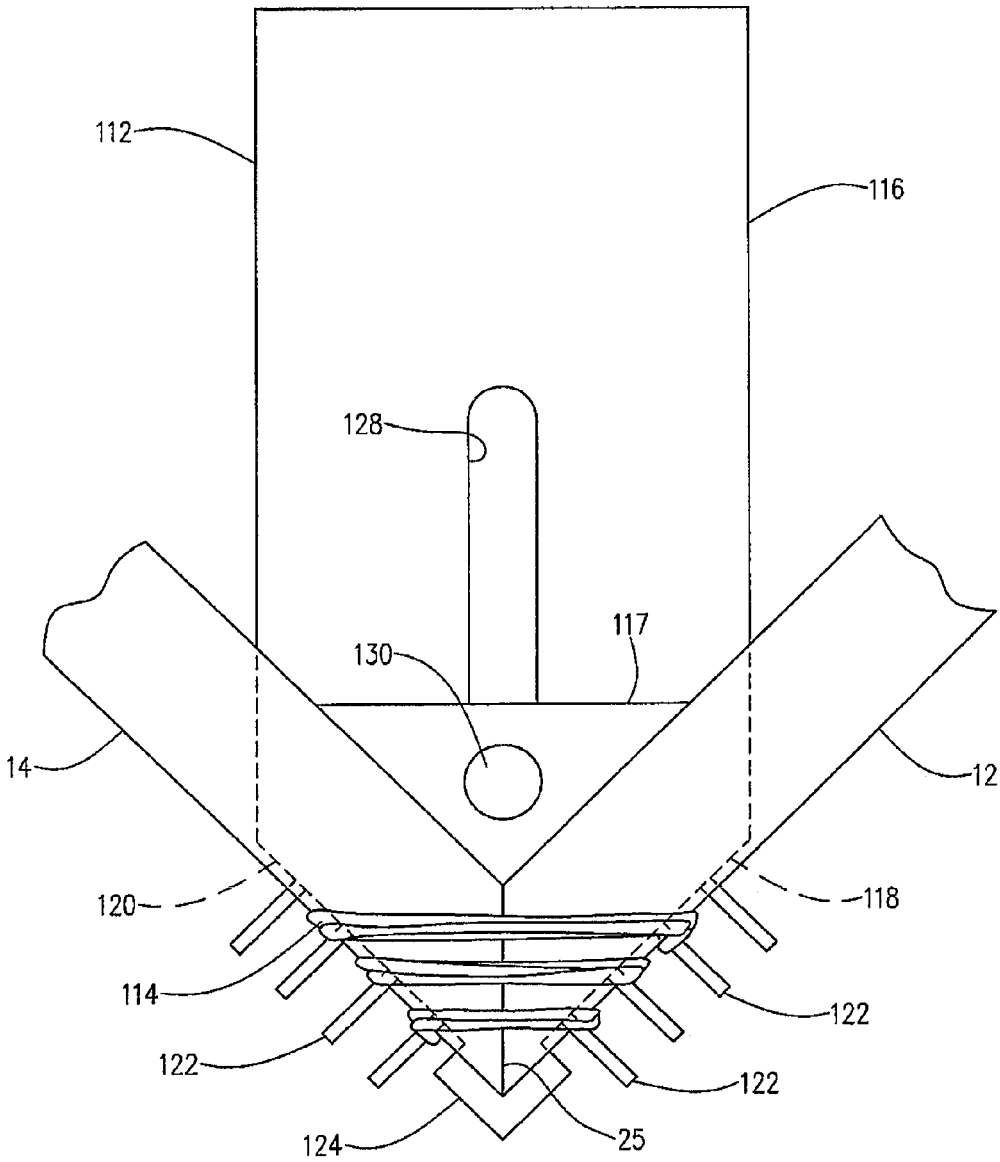
112
116
128
117
130
14
12
120
118
114
122
122
122
124
25
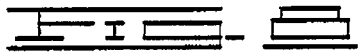

APPARATUS AND METHOD FOR CLAMPING MITERED CORNERS

CROSS REFERENCE TO RELATED APPLICATIONS

This application is a conversion of U.S. Provisional Patent Application Ser. No. 61/409,031, filed Nov. 1, 2010, the contents of which are hereby incorporated by reference in its entirety.

STATEMENT REGARDING FEDERALLY SPONSORED RESEARCH OR DEVELOPMENT

Not applicable.

BACKGROUND OF THE INVENTION

1. Field of the Invention

The present invention disclosed herein relates to clamps, and more particularly, but not by way of limitation, to an apparatus and method for clamping mitered corners (or miter joints).

2. Brief Description of Related Art

In fabricating picture frames and the like, in which the ends of adjacent frame members are mitered to form corners, it is generally desirable to minimize or entirely avoid making marks on the portions of the frame that are in view when the frame is hung on a wall. Thus, the mitered corners in many such assemblies are fastened with glue rather than with nails, which must be driven in from the outside edges of the joint members and are thereafter visible when the frame is hung on a wall.

As is well known, miter clamps are used to hold the abutting surfaces of a glued miter joint tightly together while the glue sets. For best results, the compressive joining force exerted by such clamps should be sustained and act in a direction perpendicular to the abutting surfaces which form the joint line. In addition, the frame members must be firmly held in position to prevent slipping with respect to each other during the time the glue is setting.

Traditional methods used to join mitered corners often require complex clamp devices that are generally heavy, bulky, and expensive to manufacture.

Other methods that are used to join and fasten mitered corners involve the use of plastic inserts called "thumbnails" or "wedges." Such plastic inserts are installed into cavities at the back of the mitered corners to tether ends of the frame sections together. Before these types of inserts can be installed, however, all ends of the frame sections must be machined to create necessary cavities before installation. Not only does this involve another operational step to the process of framing, it also requires specialized equipment that is rather expensive.

To this end, a need exists for an improved clamp for clamping and joining miter joints or mitered corners. It is to such an apparatus and method that the inventive concepts disclosed and claimed herein are directed.

SUMMARY OF THE INVENTION

The present invention relates to a kit for clamping a mitered corner, the mitered corner comprising a first mitered frame member and a second mitered frame member. The kit comprises a band retaining member having a base portion positionable adjacent to the first and second mitered frame members and at least one band retainer attached to the band retaining member. The kit further comprises at least one clamp band for engaging the at least one band retainer and the first and second mitered frame members to exert compressive force on the mitered corner, the band retainer preventing movement of the clamp band relative to the mitered corner.

Another embodiment of the present invention relates to a method for clamping a mitered corner between a first mitered frame member and a second mitered frame member. The method comprises the step of contacting the mitered end surfaces of the first mitered frame member and the second mitered frame member in an aligned, abutting relationship. The method further comprises the step of applying a band retaining member adjacent to a back surface of at least one of the first frame member and the second frame member, the band retaining member having at least one band retainer positioned adjacent to the mitered corner. Another step in the method includes wrapping at least one clamp band around the first and second mitered frame members and around the at least one band retainer of the band retaining member in such a way that the band extends across the mitered corner so as to exert a compressive force on the joint of the mitered corner.

BRIEF DESCRIPTION OF THE DRAWINGS

FIG. 6A is a bottom plan view, illustrating a band retaining member positioned in corresponding slots formed in mitered frame members.

FIG. 6B is a bottom plan view, illustrating a clamp band wrapped around the mitered frame members and the band retaining member.

FIG. 6C is a perspective view, illustrating the clamp band of FIG. 6B removed and the band retaining member serving the role of a corner brace member to brace the mitered frame members once joined.

FIG. 6D is a bottom plan view, illustrating another embodiment of a band retaining member positioned in corresponding slots formed in mitered frame members.

FIG. 6E is a bottom plan view, illustrating a clamp band wrapped around the mitered frame members and the band retaining member.

FIG. 6F is a perspective view, illustrating the clamp band of FIG. 6E removed and the band retaining member serving the role of a corner brace member to brace the mitered frame members once joined.

FIG. 8 is a bottom plan view illustrating a clamp band wrapped around mitered frame members and a band retaining member.

DETAILED DESCRIPTION OF EXEMPLARY EMBODIMENTS

Figure 1:
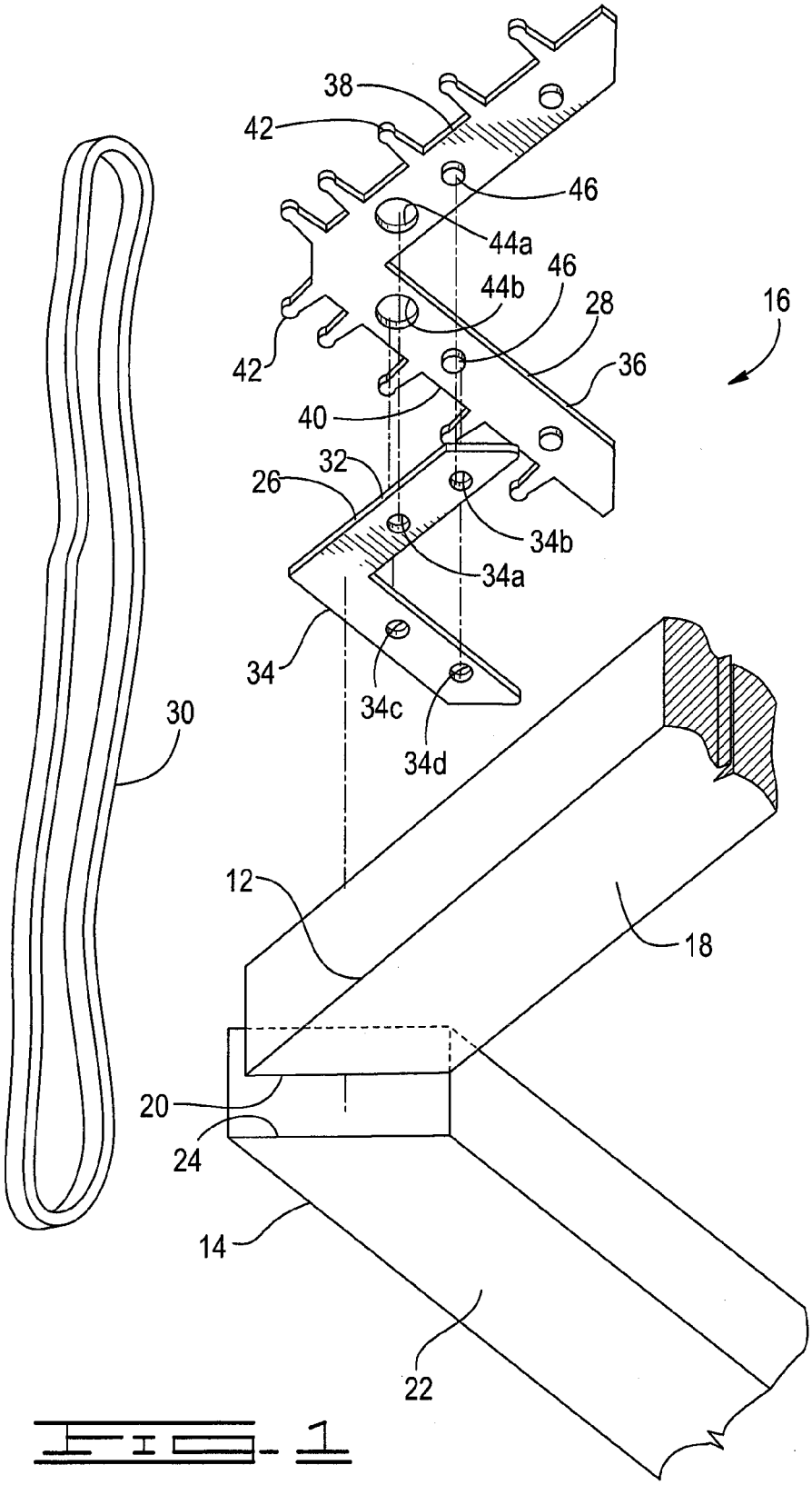
FIG. 1 is a perspective view of two mitered frame members and a clamp kit constructed in accordance with the present invention.

Before explaining at least one embodiment of the presently disclosed and claimed inventive concept(s) in detail, it is to be understood that the presently disclosed and claimed inventive concept(s) is not limited in its application to the details of construction, experiments, exemplary data, and/or the arrangement of the components set forth in the following description or illustrated in the drawings. The presently disclosed and claimed inventive concept(s) is/are capable of other embodiments or of being practiced or carried out in various ways. Also, it is to be understood that the phraseology and terminology employed herein is for the purpose of description and should not be regarded as limiting.

Referring now to the drawings, FIG. 1 illustrates two mitered frame members 12 and 14, and a clamp kit 16 constructed in accordance with the inventive concepts disclosed herein. The first mitered frame member 12 has a front surface 18, an opposing back surface, and a pair of mitered end surfaces 20 (only one of the mitered end surfaces 20 is shown in FIG. 1). Similarly, the second mitered frame member 14 has a front surface 22, an opposing back surface, and a pair of mitered end surfaces 24 (only one of the mitered end surfaces 24 is shown in FIG. 1). When the mitered end surfaces 20 and 24 are brought together in an abutting relationship they form a mitered corner, such as mitered corner 25 illustrated in FIGS. 2B, 2C, 2E, and 2F.

Picture frames are often fabricated with mitered corners. This style of corner joint is created when moldings or frame members are miter cut, most commonly at forty-five degree angles, and then brought together in an abutting relationship to form a common joint line when joined at their miter cut ends with a suitable adhesive. The clamp kit 16 provides an efficient and effective way to hold the frame members together as the adhesive is setting, so that the miter joint remains aligned and tight to provide a joint that does not detract from the appearance of the picture frame. While the clamp kit 16 as described herein is related to holding picture frame members, it should be appreciated that the clamp kit 16 is also suitable for other applications where mitered pieces are desired to be clamped and held together.

The clamp kit 16 includes a corner brace member 26, a band retaining member 28, and a clamp band 30. The corner brace member 26 is a generally L-shaped plate having a first leg 32 and a second leg 34 so as to generally correspond to the angle of the first and second mitered frame members 12 and 14 when the first and second mitered frame members 12 and 14 are brought together to form the mitered corner 25. The first leg 32 and the second leg 34 are shown to be provided with holes 34*a*, 34*b*, 34*c*, and 34*d*. The corner brace member 26 may be formed from materials such as metal, plastic, wood, or combinations thereof. The shape and size of the corner brace member 26 may be varied. In addition, the number of holes in the corner brace member 26 may vary as well. Although the corner brace member 26 is shown to be formed of one piece, it is to be appreciated that the corner brace member 26 may be formed of separate pieces, potentially connected or hinged together, to accommodate mitered corners of varying angles.

The band retaining member 28 has a base portion 36 that is shown to be a substantially L-shaped plate with a first outer edge 38 and a second outer edge 40. Like the corner brace member 26, the band retaining member 28 may be formed of materials such as metal, plastic, wood, or combinations thereof. The size and shape of the band retaining member 28 may be varied, and the number of openings may vary as well. The band retaining member 28 is shown to be formed as one piece. Similar to the corner brace member 26 mentioned above, however, the band retaining member 28 may be formed of separate pieces, potentially connected or hinged together, to cooperate with the corner brace member 26 so as to accommodate mitered corners of varying angles.

The band retaining member 28 has band retainers 42 extending from the first outer edge 38 and the second outer edge 40 in a coplanar relationship with the base portion 36. It should be understood, however, that the band retainers 42 may be oriented in any direction so long as the band retainers 42 are capable of holding the clamp band 30 about the first and second mitered frame members 12 and 14 when clamping pressure is applied in a manner that is to be described below. The band retaining member 28 preferably includes at least two passageway openings 44*a* and 44*b* that are concentrically alignable with corresponding holes 34*a* and 34*c* of corner brace member 26, respectively. The passageway openings 44*a* and 44*b* are sized to allow complete passage of fasteners, such as screw 50, through passageway openings 44*a* and 44*b* of the band retaining member 28, so as to allow the corner brace member 26 to be fastened onto the first and second mitered frame members 12 and 14.

The number, size, position, orientation and spacing of the band retainers 42 may be varied. However, the band retainers 42 should be provided of sufficient length so that the band retainers 42 extend beyond the outer edges of the first and second mitered frame members 12 and 14 when in use. In addition, the first and second outer edges 38 and 40 of the band retaining member 28 should be preferably be set back from the outer edges of the first and second mitered frame members 12 and 14 when the band retaining member 28 is engaged with the corner brace member 26 in a manner to be discussed below. The band retainers 42 are preferably positioned, relative to passageway openings 44*a* and 44*b* of the band retaining member 28, such that passageway openings 44*a* and 44*b* remain substantially unobstructed when the clamp band 30 is wrapped around the first and second mitered frame members 12 and 14 and about the band retainers 42 of the band retaining member 28 in a manner to be discussed below.

Figure 2A:
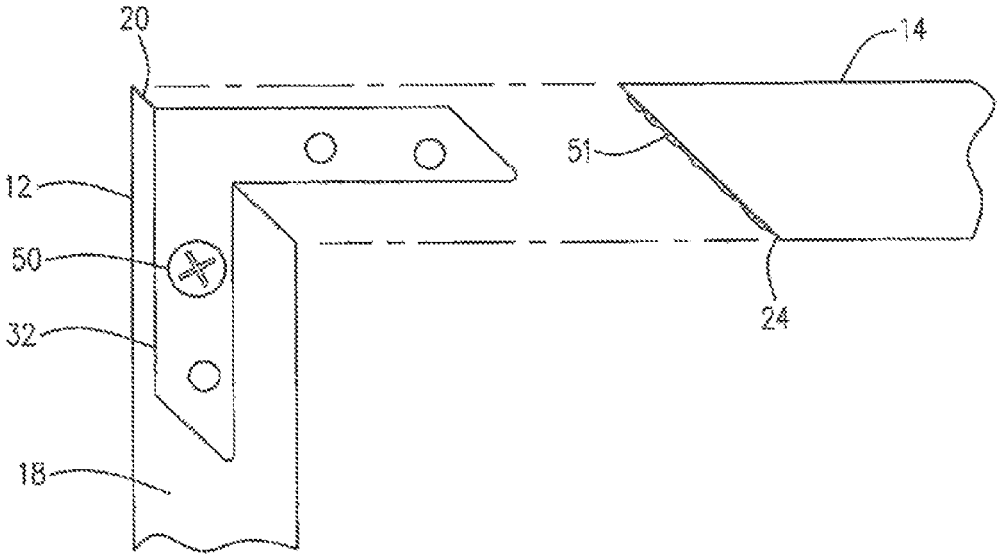
FIG. 2A is a bottom plan view, illustrating a corner brace member attached to one of the mitered frame members.
Figure 2B:
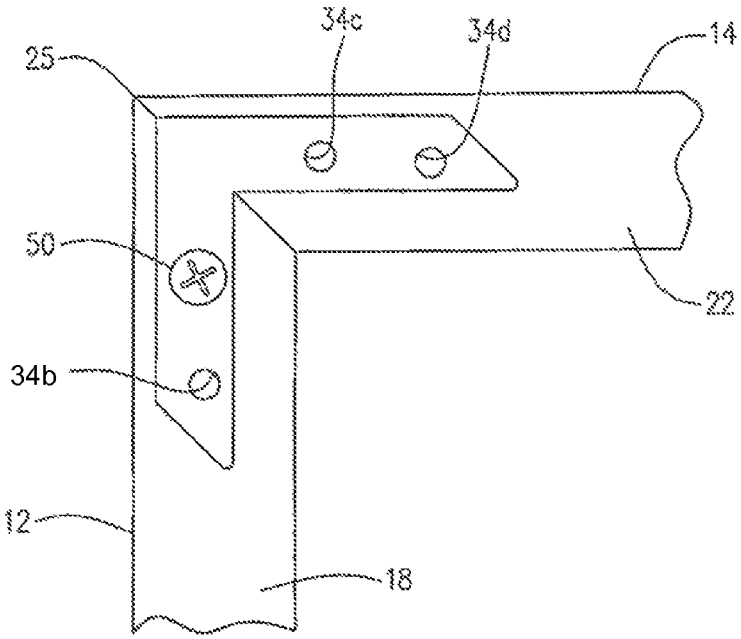
FIG. 2B is a bottom plan view, illustrating the mitered frame members brought together in an abutting relationship.
Figure 2C:
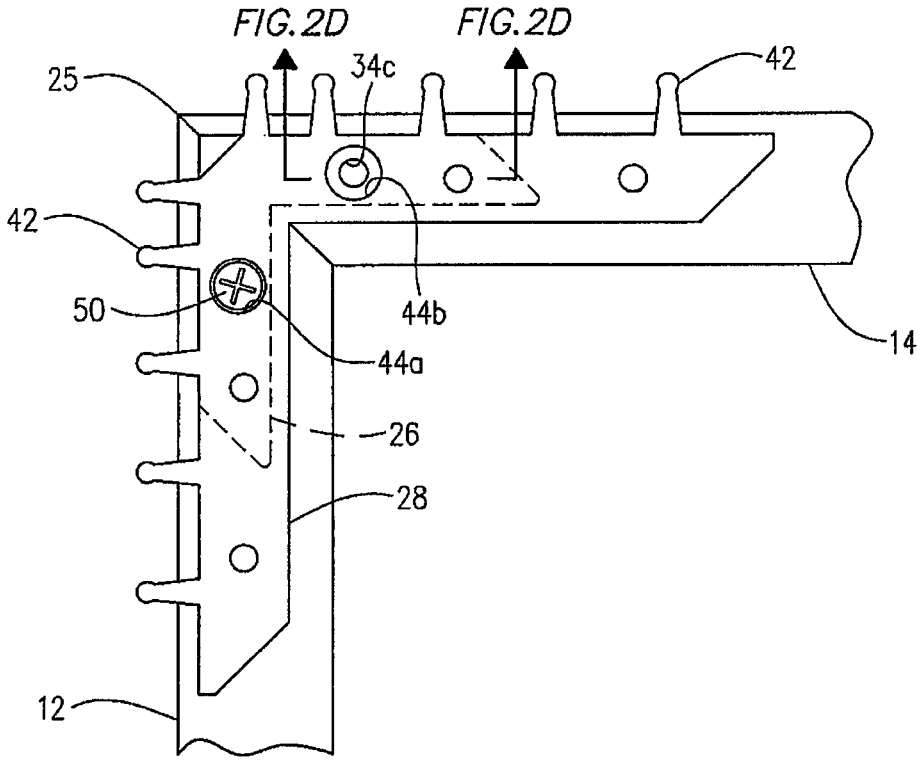
FIG. 2C is a bottom plan view, illustrating a band retaining member positioned on the corner brace member.
Figure 2D:
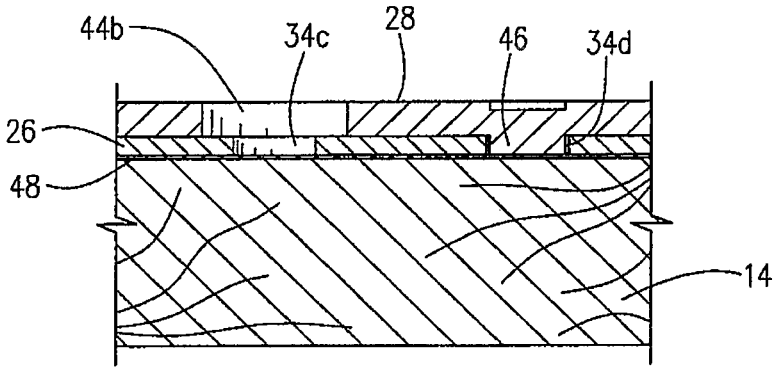
FIG. 2D is a fragmented sectional view, illustrating the band retaining member mating with the corner brace member, and an adhesive layer between the corner brace member and the mitered frame members, taken along line 2D-2D of FIG. 2C.

As shown in FIG. 1 and FIG. 2D, the band retaining member 28 is provided with mating protrusions 46 (only one being visible in FIG. 2D) extending from one surface thereof, such that the mating protrusions 46 are mateable with corresponding hole 34*b* of the first leg 32 and corresponding hole 34*d* of the second leg 34 of corner brace member 26, thereby permitting the band retaining member 28 to register and engage with the corner brace member 26 when in use. It is to be appreciated that the corner brace member 26 and the band retaining member 28 may be configured in a variety of ways so that they can engage with one another. For example, the corner brace member 26 may be alternatively formed to have one or more notches along one or more of its edges to accommodate registration and engagement of band retaining member 28. In another example, the corner brace member 26 may be configured differently to include one or more mating protrusions, and the band retaining member 28 may be provided with corresponding voids, such as recesses, notches, or holes.

The clamp band 30 may be constructed of any pliable and tensionable material. However, the clamp band 30 is preferably constructed of an elastic material, such as rubber, latex, or other similar materials. It should be understood and appreciated that the clamp band 30 can be constructed of any material capable of being wrapped and tensioned when configured about the mitered corner 25. Also, the clamp band 30 may be a continuous loop, or broken so as to have opposite free ends. In addition, the number of clamp bands 30 used may be varied.

In use, referring to FIG. 2A, the first leg 32 of the corner brace member 26 is positioned on the back surface of the first mitered frame member 12 with the intersection of the first leg 32 and the second leg 34 aligned with the mitered end surface 20. In one embodiment, the corner brace member 26 may be provided with an adhesive layer 48 (shown in FIG. 2D) to facilitate attachment of the corner brace member 26 to the mitered frame members 12 and 14. The adhesive layer 48 is preferably a double coated pressure sensitive tape. As shown in FIG. 2A, a fastener such as screw 50, may next be installed through the hole 34*a* of the first leg 32 of corner brace member 26 to further secure the corner brace member 26 onto the back surface of first mitered frame member 12. Alternatively, screw 50 may be installed later.

Next, glue (identified in FIG. 2A by the reference numeral 51) is applied to at least one of the mitered end surfaces 20 and 24, and the first and second mitered frame members 12 and 14 are brought together in an abutting relationship, as illustrated in FIG. 2B. With the first and second frame members 12 and 14 held together and aligned, the corner brace member 26 may then be adhesively attached to the second mitered frame member 14 via the adhesive layer 48 as shown in FIG. 2D.

The band retaining member 28 is then positioned on the corner brace member 26 so that the mating protrusions 46 of the band retaining member 28 mate with corresponding holes 34*b* and 34*d* of the corner brace member 26, as illustrated in FIGS. 2C and 2D, so as to register and engage the band retaining member 28 with the corner brace member 26, and to cause the band retainers 42 of the band retaining member 28 to extend beyond the outer edges of the first and second mitered frame members 12 and 14.

Figure 2E:
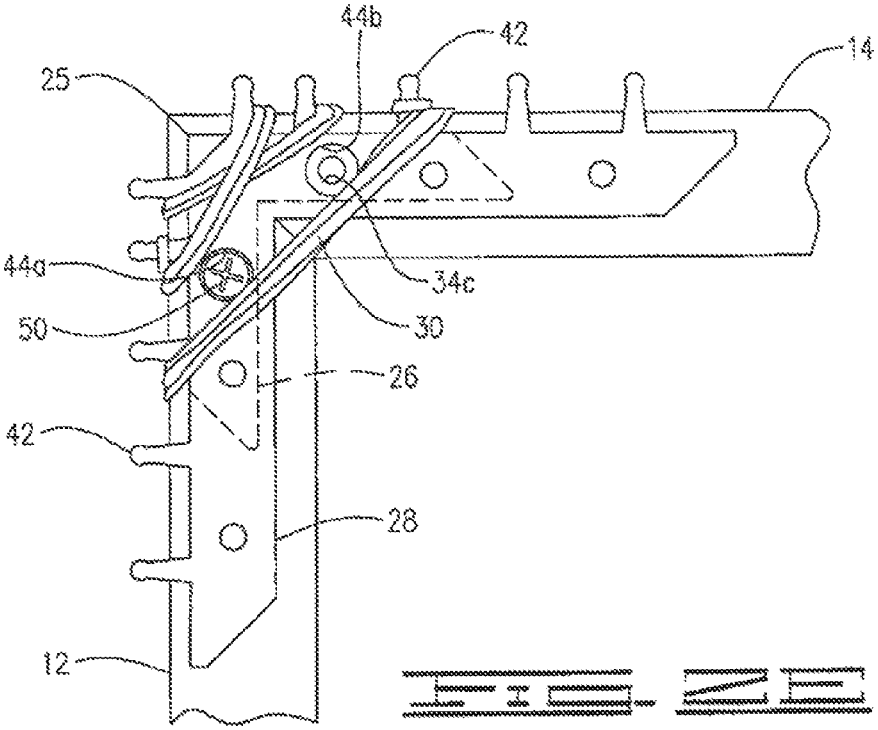
FIG. 2E is a bottom plan view, illustrating a clamp band wrapped around the mitered frame members and the band retaining member.

Referring now to FIG. 2E, the clamp band 30 is next wrapped around the first and second mitered frame members 12 and 14 and about the band retainers 42 of the band retaining member 28 in such a way that the clamp band 30 extends across the joint of the mitered corner 25 so as to exert a compressive force in a direction substantially perpendicular to the joint of the mitered corner 25. In one manner of attachment, the clamp band 30 is looped over one of the band retainers 42 and then tensioned and wrapped around the front surfaces 18 and 22 of the first and second mitered frame members 12 and 14 and across the band retaining member 28 such that the band retainers 42 function to hold the clamp band 30. The clamp band 30 is finally looped over one of the band retainers 42 to secure the clamp band 30 to the band retaining member 28. Preferably, the clamp band 30 is wrapped multiple times around the first and second mitered frame members 12 and 14 so as to multiply compressive force upon the joint of the mitered corner 25. As the clamp band 30 is wrapped, it is also desirable that the clamp band 30 be configured in a manner that results in the clamp band 30 remaining within the inner and outer boundaries of the joint of the mitered corner 25 in order to avoid the application of undesired angular forces on the mitered frame members 12 and 14. After the clamp band 30 has been tensionably wrapped and secured to clamp the mitered corner 25, screw 50 may be driven through passageway opening 44*b* and into hole 34*c* to secure the second leg 34 of the corner brace member 26 to mitered frame member 14.

Figure 2F:
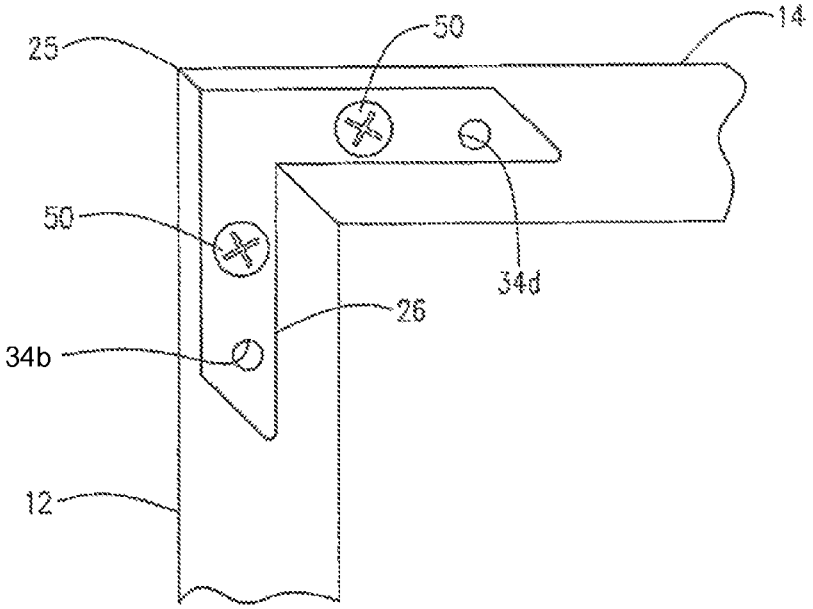
FIG. 2F is a bottom plan view, illustrating joined mitered frame members braced with the corner brace member.

After the glue 51 has had sufficient time to bond the first and second mitered frame members 12 and 14, the clamp band 30 and the band retaining member 28 are then removed, as illustrated in FIG. 2F, leaving the corner brace member 26 in place and secured to the first and second mitered frame members 12 and 14.

In the above mentioned embodiment, the adhesive layer 48 is to serve two functions. First, the adhesive layer 48 merely facilitates to hold the first and second mitered frame members 12 and 14 when brought together to form the mitered corner 25. Secondly, the adhesive layer 48 holds the assembly of the corner brace member 26, the band retaining member 28 and the clamp band 30 on the mitered corner 25 when clamping pressure is applied. As an alternative to employing the adhesive layer 48 to hold the clamping assembly in position when clamping pressure is applied, it is to be appreciated that the corner brace member 26 may be alternatively secured with at least two fasteners. For example, with different design and/or methodology, at least two fasteners, such as screw 50, may be installed to fasten the first leg 32 of corner brace member 26 prior to application of clamping pressure.

Figure 3:
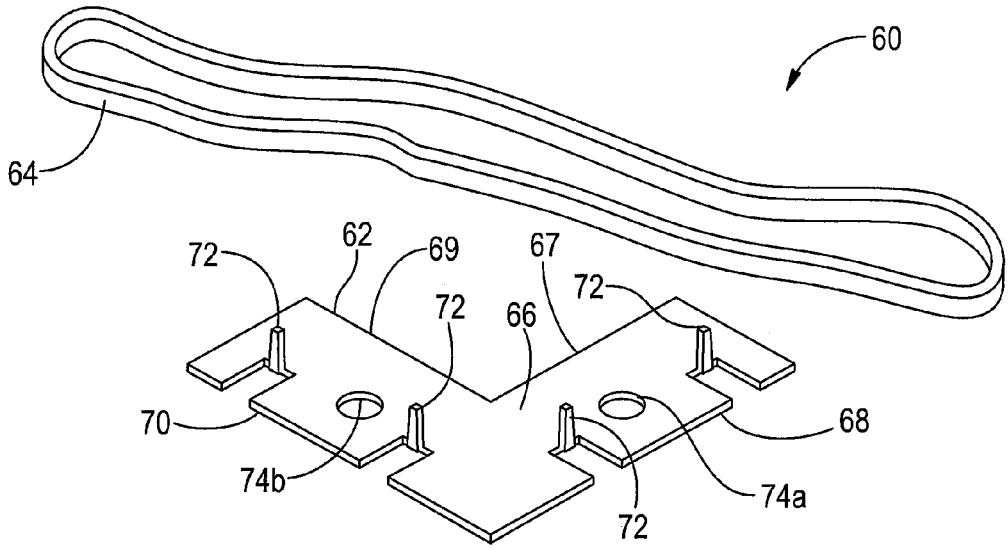
FIG. 3 is a perspective view of another embodiment of a clamp kit constructed in accordance with the inventive concepts disclosed herein.

Referring now to FIG. 3, another embodiment of a clamp kit 60 constructed in accordance with the inventive concepts disclosed herein is shown. The clamp kit 60 includes a band retaining member 62 and a clamp band 64. The band retaining member 62 has a base portion 66 that may be a substantially L-shaped plate having a first leg 67 and a second leg 69 with a first outer edge 68 and a second outer edge 70. While the band retaining member 62 is shown to be formed as a single piece, it should be appreciated that the band retaining member 62 may also be formed of separate pieces, potentially connected or hinged together, to permit the position of one piece to be adjusted relative to the other piece to accommodate mitered corners of varying degrees.

The band retaining member 62 is shown to have a plurality of band retainers 72 extending from the first outer edge 68 and the second outer edge 70 in a substantially perpendicular relationship with the base portion 66. It is to be understood that band retainers 72 may be formed in any direction, including a coplanar relationship with the base portion 66, so long at the band retainers 72 are capable of holding the clamp band 64 about the first and second mitered frame members 12 and 14 when clamping pressure is applied to the mitered corner 25. The band retaining member 62 may include at least two holes 74*a* and 74*b* to permit fasteners, such as screw 76, to be used to brace the mitered corner 25 in a manner similar to that described above in reference to the corner brace member 26.

The construction of the band retaining member 62 allows it to function similar to the combination of the corner brace member 26 and the band retaining member 28 described above. To this end, the band retainers 72 are formed so that they may be either bent into a coplanar relationship with base portion 66 after the clamp band 64 is removed, or removed entirely. The number, size, position, and spacing of the band retainers 72 may be varied. However, the band retainers 72 are preferably positioned relative to the holes 74*a* and 74*b* of the band retaining member 62 such that the holes 74*a* and 74*b* remain substantially unobstructed when the clamp band 64 is wrapped around the first and second mitered frame members 12 and 14 and about the band retainers 72 of the band retaining member 62 in a manner to be discussed below.

In use, the first leg 67 of the base portion 66 is positioned on the back surface of the first mitered frame member 12 with the intersection of the first leg 67 and second leg 69 aligned with the mitered end surface of the first mitered frame member 12. In one embodiment, the band retaining member 62 may be provided with an adhesive layer, similar to the adhesive layer 48 illustrated in FIG. 2D, to facilitate attachment of the band retaining member 62 onto the mitered frame members 12 and 14. To further secure the band retaining member 62 to the first mitered frame member 12, a fastener, such as a screw 76, may be installed through hole 74*a*.

Next, glue is applied to at least one of the mitered end surfaces, and the first and second mitered frame members 12 and 14 are brought together in an abutting relationship. With the first and second mitered frame members 12 and 14 together and aligned, the band retaining member 62 may then be adhesively attached to the second mitered frame member 14.

Figure 4A:
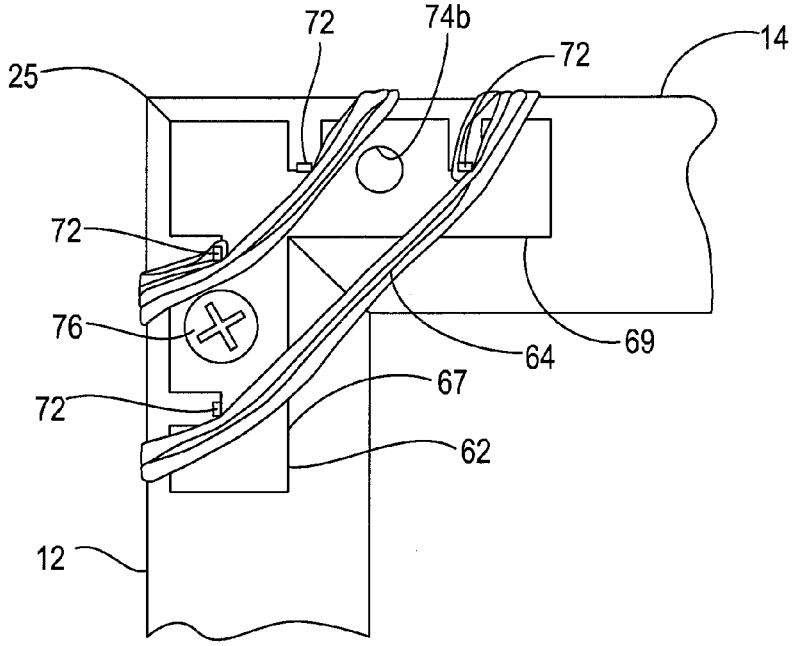
FIG. 4A is a bottom plan view, illustrating a clamp band wrapped around mitered frame members and a band retaining member.

Referring to FIG. 4A, the clamp band 64 is next tensioned and wrapped around the first and second mitered frame members 12 and 14 and about the band retainers 72 of the band retaining member 62 in such a way that the clamp band 64 extends across the joint of the mitered corner 25 so as to exert a compressive force in a direction substantially perpendicular to the joint of the mitered corner 25. In one manner of attachment, the clamp band 64 is looped over one of the band retainers 72 and then wrapped around the first and second mitered frame members 12 and 14 and across the band retaining member 62 such that the band retainers 72 function to hold the clamp band 64 in place. The clamp band 64 is finally looped over one of the band retainers 72 to secure the clamp band 64 to the band retaining member 62.

As the clamp band 64 is being wrapped, it is preferable that the clamp band 64 stay within the inner and outer boundaries of the joint of the mitered corner 25 to avoid the application of undesired angular forces on the mitered frame members 12 and 14. Also, when an adhesive layer is employed, such as adhesive layer 48 illustrated in FIG. 2D, and should screw 76 had not been previously installed into the first mitered frame member 12, it is desirable for the clamp band 64 to be configured in a manner that results in holes 74*a* and 74*b* of the band retaining member 62 to remain substantially unobstructed by the clamp band 64 to facilitate later installation of screws 76 through holes 74*a* and 74*b*.

Figure 4B:
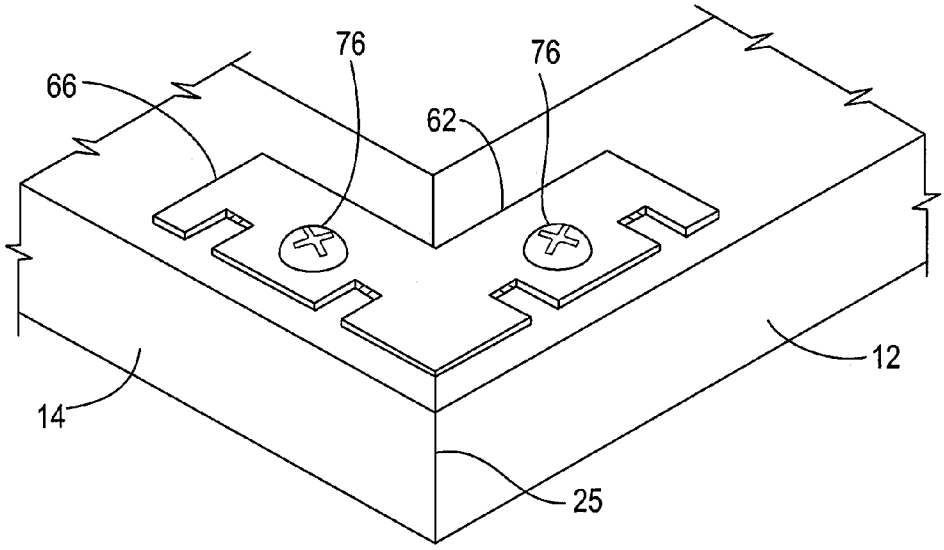
FIG. 4B is a perspective view, illustrating the clamp band of FIG. 4A removed and band retainers on the band retaining member removed as well.

After the glue 51 has had sufficient time to bond the first and second mitered frame members 12 and 14 together, screw(s) 76 may be installed to further secure the band retaining member 62 to the mitered corner 25. Afterwards, the clamp band 64 is removed and the band retainers 72 are then either bent into a coplanar relationship with the base portion 66, or the band retainers 72 are removed entirely, as illustrated in FIG. 4B, leaving the base portion 66 of the band retaining member 62 in place and secured to brace the mitered frame members 12 and 14.

In the most recently mentioned embodiment, it is to be appreciated that the band retaining member 62 may be alternatively fastened before clamping pressure is applied. For example, with different design and/or methodology, at least two fasteners, such as screw 76, may be installed to secure the first leg 67 of the band retaining member 62 onto of first mitered frame member 12 prior to application of clamping pressure.

Figure 5:
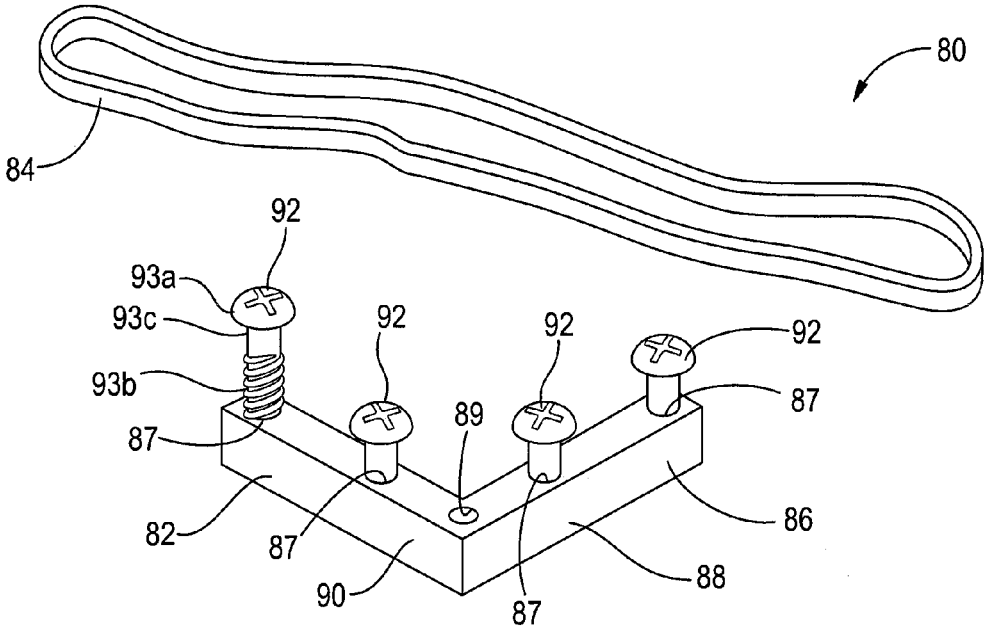
FIG. 5 is a perspective view of another embodiment of a clamp kit constructed in accordance with the inventive concepts disclosed herein.
Figure 5A:
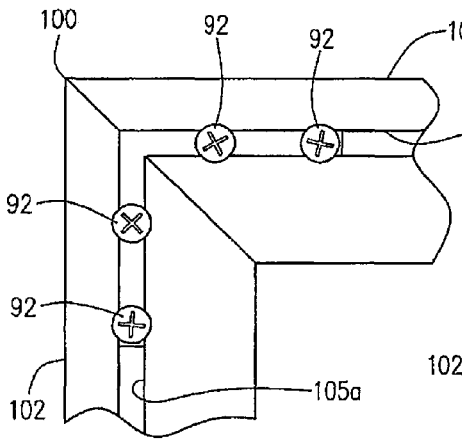
Figure 5B:
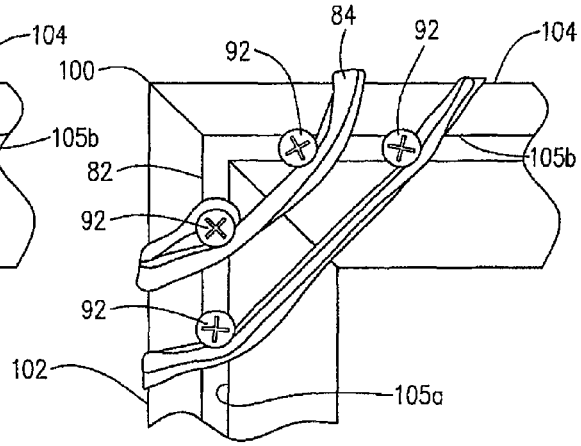
Figure 5C:
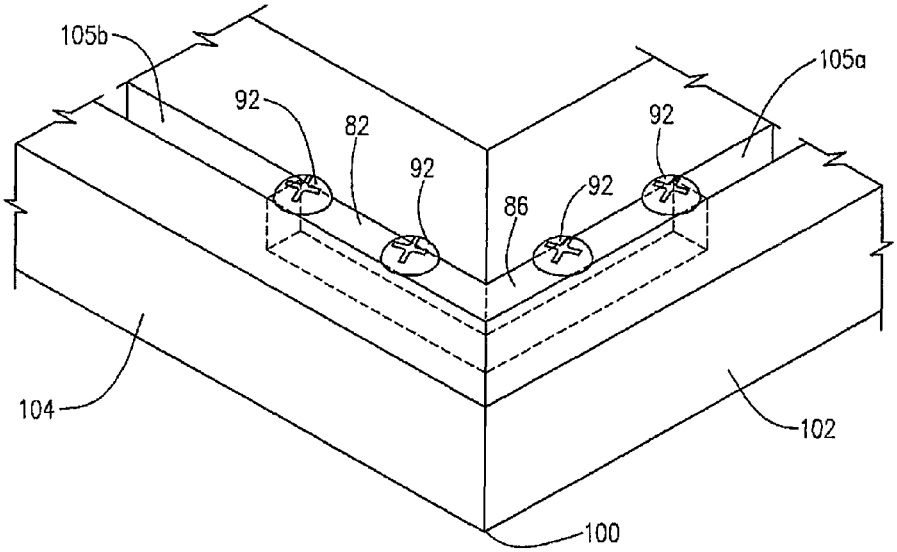
Figure 5D:
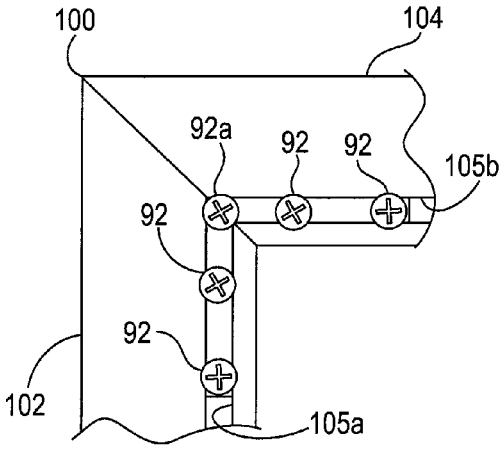
Figure 5E:
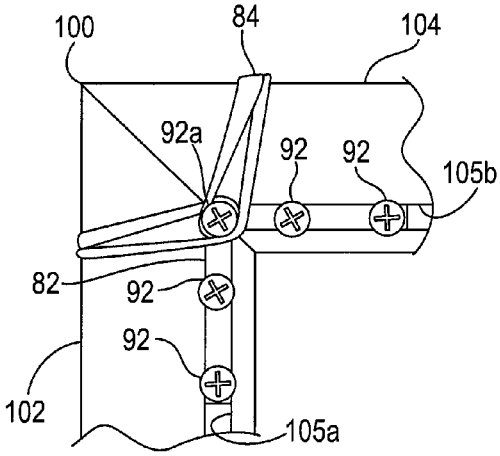
Figure 5F:
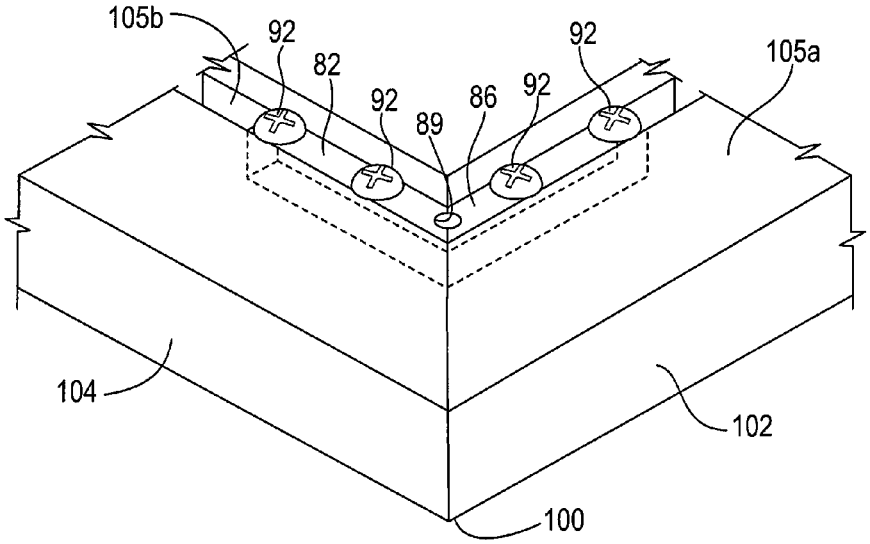

Referring now to FIG. 5, another embodiment of a clamp kit 80 constructed in accordance with the inventive concepts disclosed herein is shown. The clamp kit 80 includes a band retaining member 82 and a clamp band 84. The clamp kit 80 is intended to clamp and join two mitered frame members 102 and 104 where each of the mitered frame members 102 and 104 has a linear slot 105*a* and 105*b* (FIG. 6A), respectively. In this embodiment, the band retaining member 82 may also perform the function of bracing the mitered corner 100, similar to the corner brace 26 described herein. The band retaining member 82 has a base portion 86 that is shaped to fit within the linear slots 105*a* and 105*b* and thus, the base portion 86 is provided with a first leg 88 and a second leg 90. It is to be appreciated that the first leg 88 and the second leg 90 may be separate pieces, potentially connected or hinged together, to accommodate mitered corners of varying degrees.

The band retaining member 82 has a plurality of band retainers 92 extending from holes 87 in a substantially perpendicular relationship with the base portion 86. In this embodiment, the band retainers 92 may perform two functions. In an upwards position, the band retainers 92 provide the clamp band 84 with something to engage with in order to provide compressive force. When driven into a downward position, the band retainers 92, being screws, may also serve to fasten the band retaining member 82 onto the two mitered frame members 102 and 104. In FIGS. 5-6F, the band retainers 92 are illustrated as fasteners with a head 93*a*, a threaded shaft portion 93*b*, and a smooth shaft portion 93*c*. It should be understood and appreciated that the band retainers 92 could also be fasteners wherein the entire shaft is threaded.

The construction of the band retaining member 82 shown allows it to function similar to the combination of the corner brace member 26 and the band retaining member 28 described above. To this end, the band retainers 92, being screws, are movable relative to the base portion 86 through the holes 87 such that the band retainers 92 may serve to support the clamp band 84 in a first position (FIGS. 5, 6A, and 6B) and, once driven, to secure the base portion 86 to the mitered frame members 102 and 104 in a second position (FIG. 6C).

In use, glue 51 is first applied to at least one of the mitered end surfaces of the mitered frame members 102 and 104. The mitered end surfaces are then brought together in an abutting relationship. With the mitered frame members 102 and 104 together and aligned, the band retaining member 82 is inserted into the linear slots 105*a* and 105*b*, as shown in FIG. 6A, such that the band retainers 92 extend away from the back surfaces of the mitered frame members 102 and 104 and the smooth shaft portion 93*c* of the band retainers 92 is exposed for contact with the clamp band 84.

Referring to FIG. 6B, the clamp band 84 is next wrapped around the mitered frame members 102 and 104 and about the band retainers 92 of the band retaining member 82 in such a way that the clamp band 84 extends across the joint of mitered corner 100 so as to exert a compressive force in a direction substantially perpendicular to the joint of the mitered corner 100. In one manner of attachment, the clamp band 84 is looped over one of the band retainers 92 and then tensioned and wrapped around the mitered frame members 102 and 104 and across the band retaining member 82 such that the band retainers 92 function to hold the clamp band 84 in place. The clamp band 84 is then finally looped over one of the band retainers 92 to secure the clamp band 84 to the band retaining member 82.

After the glue 51 has had sufficient time to bond the mitered frame members 102 and 104, the clamp band 84 is removed and the band retainers 92 are moved to the second position wherein the band retainers 92, being screws, are driven into the mitered frame members 102 and 104, as illustrated in FIG. 6C, thereby leaving the base portion 86 of the band retaining member 82 secured so as to brace the mitered frame members 102 and 104.

Referring again to FIG. 5, another embodiment of a clamp kit 80 constructed in accordance with the inventive concepts disclosed herein is shown. The band retaining member 82 of clamp kit 80 further includes a band retainer hole 89. The clamp kit 80 is intended to clamp and join the two mitered frame members 102 and 104 via the linear slots 105*a* and 105*b* (FIG. 6D), respectively. The band retainer hole 89 is configured to receive a single band retainer 92*a* in a substantially perpendicular relationship with the base portion 86. It should be understood and appreciated that the slots 105*a* and 105*b* can be positioned in different locations on the back surface of the two mitered frame members 102 and 104 to facilitate the compression of the two mitered frame members 102 and 104.

In this embodiment, the single band retainer 92*a* may provide the clamp band 84 with something to engage with in order to provide compressive force (See FIG. 6E). When the clamp band 84 is engaged with the single band retainer 92*a*, the other band retainers 92, being screws, fasten the band retaining member 82 onto the two mitered frame members 102 and 104. The clamp band 84 and the single band retainer 92*a* can be removed from the band retaining member 82 after the other band retainers 92 fasten the base portion 86 to the two mitered frame members 102 and 104 (FIG. 6F).

In use, glue 51 is first applied to at least one of the mitered end surfaces of the mitered frame members 102 and 104. The mitered end surfaces are then brought together in an abutting relationship. With the first and second mitered frame members 102 and 104 together and aligned, the band retaining member 82 is inserted into the linear slots 105*a* and 105*b*, as shown in FIG. 6D, such that the single band retainer 92*a* and the other band retainers 92 extend away from the back surfaces of the mitered frame members 102 and 104 and the single band retainer 92*a* is exposed for contact with the clamp band 84.

Referring to FIG. 6E, the clamp band 84 is next wrapped around the mitered frame members 102 and 104 and about the single band retainer 92*a* of the band retaining member 82 in such a way that the clamp band 84 extends across the joint of mitered corner 100 so as to exert a compressive force in a direction substantially perpendicular to the joint of the mitered corner 100. In one manner of attachment, the clamp band 84 is looped over the single band retainer 92*a* and then tensioned and wrapped around the mitered frame members 102 and 104 and then back around the single band retainer 92*a* to hold the clamp band 84 in place. The clamp band 84 is then finally looped over the single band retainer 92*a* to secure the clamp band 84 to the band retaining member 82. After clamping pressure has been applied, the band retainers 92 may be moved to a second position wherein the band retainers 92, being screws, are driven into the mitered frame members 102 and 104 so as to brace the mitered corner 100.

After the glue 51 has had sufficient time to bond the first and second mitered frame members 102 and 104, the clamp band 84 and screw 92*a* are removed from the joined mitered corner 100, as illustrated in FIG. 6F.

Figure 7:
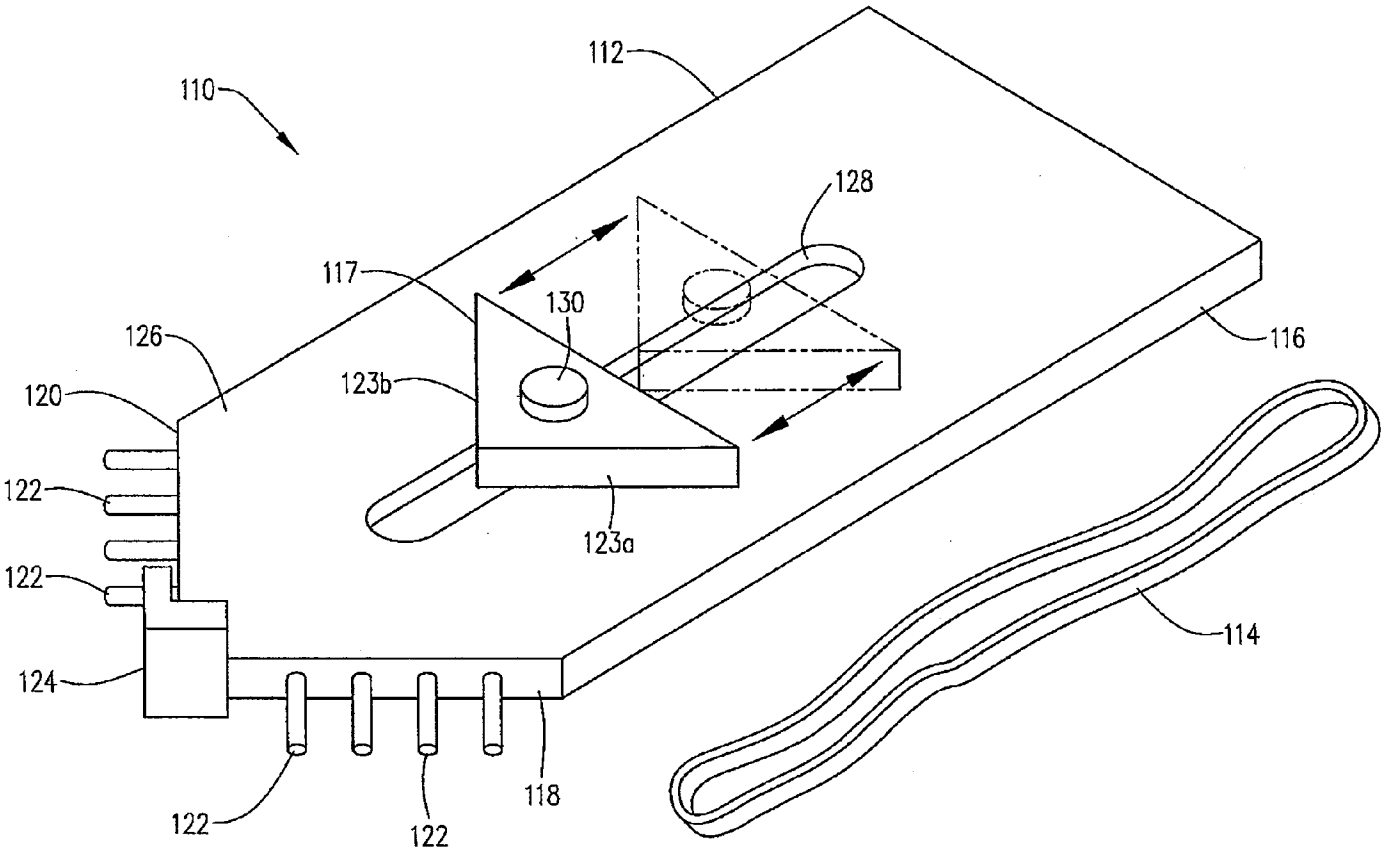
FIG. 7 is a perspective view of another embodiment of a clamp kit constructed in accordance with the inventive concepts disclosed herein.

Referring now to FIG. 7, another embodiment of a clamp kit 110, constructed in accordance with the inventive concepts disclosed herein, is shown. The clamp kit 110 includes a band retaining member 112 and a clamp band 114. The band retaining member 112 has a base portion 116 and a brace member 117. The base portion 116 is a plate provided with a first outer edge 118 and a second outer edge 120. The base portion 116 may be formed of any rigid material, such as metal, plastic, wood or combinations thereof, and the size and shape of the base portion 116 may be varied. The base portion 116 is provided with a plurality of band retainers 122 extending from the first outer edge 118 and the second outer edge 120 in a substantially co-planar relationship with the base portion 116.

The brace member 117 has a first edge 123*a* and a second edge 123*b* that is connected to the base portion 116 such that the first edge 123*a* of the brace member 117 is parallel to the first outer edge 118 of the base portion 116 and the second edge 123*b* of the brace member 117 is parallel to the second outer edge 120 of the base portion 116. In another embodiment of the present invention, the base portion 116 may be provided with a ridge 124 along the first and second outer edges 118 and 120 so as to cooperate with the brace member 117 to define a frame member receiving channel 126. To accommodate frame members of varying widths, the brace member 117 may be connected to the base portion 116 so that the brace member 117 is adjustably movable along the base portion 116. By way of example, the base portion 116 may be provided with a longitudinal slot or channel 128 for receiving a shaft (not shown) and a knob 130 configured to permit selective adjustment of the position of the brace member 117 relative to the base portion 116 to accommodate frame members of various widths.

In use, glue 51 is first applied to at least one of the mitered end surfaces of the mitered frame members 12 and 14, and the mitered end surfaces are brought together in an abutting relationship and positioned in the frame member receiving channel 126 wherein the brace member 117 may be adjusted relative to the base portion 116 to partially clamp the first and second mitered frame members 12 and 14. With the first and second mitered frame members 12 and 14 together and aligned, the clamp band 114, as shown in FIG. 8, is next wrapped around the mitered frame members 12 and 14 and about the band retainers 122 of the band retaining member 112 in such a way that the clamp band 114 extends across the mitered corner 25 so as to exert a compressive force in a direction substantially perpendicular to the joint of the mitered corner 25. In one manner of attachment, the clamp band 114 is looped over one of the band retainers 122 and then stretched and wrapped around the front surfaces of the mitered frame members 12 and 14 and across the base portion 116 of the band retaining member 112 such that the band retainers 122 function to hold the clamp band 114 in place. The clamp band 114 is then looped over one of the band retainers 122 to secure the clamp band 114 to the band retaining member 112.

After the glue 51 has had sufficient time to bond the mitered frame members 12 and 14, the clamp band 114 and the band retaining member 112 are removed, thereby leaving the mitered frame members 12 and 14 joined to one another.

From the above description, it is clear that the inventive concepts disclosed and claimed herein are well adapted to carry out the objects and to attain the advantages mentioned herein, as well as those inherent in the invention. While presently preferred embodiments of the inventive concepts have been described for purposes of this disclosure, it will be understood that numerous changes may be made which will readily suggest themselves to those skilled in the art and which are accomplished within the spirit of the inventive concepts disclosed and as defined in the appended claims.

What is claimed is:

1. A method for clamping a mitered corner between a first mitered frame member and a second mitered frame member, the method comprising:

contacting the mitered end surfaces of the first mitered frame member and the second mitered frame member in an aligned, abutting relationship;

applying a band retaining member adjacent to a back surface of at least one of the first frame member and the second frame member, the band retaining member having at least one band retainer positioned adjacent to the mitered corner; and wrapping at least one clamp band around the first and second mitered frame members and around the at least one band retainer of the band retaining member in such a way that the band extends across the mitered corner so as to exert a compressive force on the joint of the mitered corner.

2. The method of claim 1 further comprising:

attaching a portion of the band retaining member to the back surface of at least one of the first and second mitered frame members prior to contacting the mitered end surfaces to one another and attaching another portion of the band retaining member to the back surface of the other first and second mitered frame members subsequent to contacting the mitered end surfaces.

3. The method of claim 2 further comprising applying glue to at least one mitered end surface of the first mitered frame member and the second mitered frame member.

4. The method of claim 3 further comprising removing the clamp band from the band retaining member and removing the at least one band retainer from the band retaining member subsequent to the glue setting.

5. The method of claim 1 further comprising:

attaching a portion of a corner brace member to the back surface of at least one of the first and second mitered frame members prior to contacting the mitered end surfaces to one another and prior to applying the band retaining member;

attaching another portion of the corner brace member to the back surface of the other first and second mitered frame members subsequent to contacting the mitered end surfaces; and engaging the band retaining member with the corner brace member.

6. The method of claim 5 wherein the other portion of the corner brace member is attached to the first or second mitered frame member subsequent to attaching the band retaining member.

7. The method of claim 5 further comprising removing the clamp band from the band retaining member and removing the band retaining member from the corner brace member subsequent to the glue setting, thereby leaving the plate attached to the first and second mitered frame member.

8. The method of claim 1 wherein the band retaining member is positionable in slots disposed in the first and second mitered frame members.

* * * * *